US007395014B2

(12) United States Patent
Kim et al.

(10) Patent No.: US 7,395,014 B2
(45) Date of Patent: Jul. 1, 2008

(54) IMAGE FORMING APPARATUS

(75) Inventors: Young-Min Kim, Suwon-si (KR); Sang-Cheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 115 days.

(21) Appl. No.: 11/179,524

(22) Filed: Jul. 13, 2005

(65) Prior Publication Data

US 2006/0034637 A1 Feb. 16, 2006

(30) Foreign Application Priority Data

Aug. 13, 2004 (KR) ..... 10-2004-0064003

(51) Int. Cl.
*G03G 15/01* (2006.01)

(52) U.S. Cl. ..... 399/228; 399/222

(58) Field of Classification Search ..... 399/228, 399/222

See application file for complete search history.

(56) References Cited

U.S. PATENT DOCUMENTS

| | | | | |
|---|---|---|---|---|
| 6,078,777 | A | 6/2000 | Imumi et al. | |
| 6,285,847 | B1 * | 9/2001 | Tanizaki et al. | 399/167 |
| 6,466,755 | B2 | 10/2002 | Yano et al. | |
| 2001/0012461 | A1 * | 8/2001 | Yano et al. | 399/222 |
| 2001/0046393 | A1 * | 11/2001 | Uchida | 399/228 |
| 2002/0110386 | A1 * | 8/2002 | Kanno et al. | 399/228 |

FOREIGN PATENT DOCUMENTS

| | | |
|---|---|---|
| JP | 05-066662 | 3/1993 |
| JP | 10-171203 | 6/1998 |
| JP | 10-171216 | 6/1998 |
| JP | 11-338211 | 12/1999 |
| JP | 2000-029280 | 1/2000 |
| JP | 2003-076103 | 3/2003 |
| KR | 1020020066228 A | 8/2002 |

OTHER PUBLICATIONS

Abstract and Drawings of JP 04-043378.*

* cited by examiner

*Primary Examiner*—David M Gray
*Assistant Examiner*—Ryan D. Walsh
(74) *Attorney, Agent, or Firm*—Roylance, Abrams, Berdo & Goodman, L.L.P.

(57) ABSTRACT

An improved image forming apparatus comprises a first developing unit comprising a photosensitive body. Also provided is a second developing unit including a developing roller which is moveably installed so that the developing roller selectively contacts the photosensitive body. A pressing member selectively presses the second developing unit. The developing roller contacts the photosensitive body during a developing process and separates from the photosensitive body after the developing process is finished.

15 Claims, 7 Drawing Sheets

IMAGE FORMING APPARATUS

CROSS-REFERENCE TO RELATED APPLICATIONS

This application claims the benefit under 35 U.S.C. 119(a) of Korean Patent Application No. 2004-64003, filed Aug. 13, 2004, the entire disclosure of which is hereby incorporated by reference.

BACKGROUND OF THE INVENTION

1. Field of the Invention

The present invention relates to an image forming apparatus. More particularly, the present invention relates to an image forming apparatus in which a developing roller makes contact with a photosensitive body during an image developing process and separates from the photosensitive body after the developing process is finished.

2. Description of the Related Art

In general, image forming apparatuses, such as laser printers, light emitting diode (LED) printers, digital copiers, facsimiles, and multi-functional devices, transfer an image signal. The image signal is transferred according to an input digital signal, as a visible image, to a printing medium such as a sheet of paper to print the visible image. Such an image forming apparatus generally comprises a developing unit, a laser scanning unit, a transfer medium, and a fixing unit.

The developing unit comprises a photosensitive body on which the visible image is developed. The developing unit also comprises a developing roller to transfer a developer to the photosensitive body and to develop the visible image on the photosensitive medium. An electrostatic latent image corresponding to the visible image is formed on the surface of the photosensitive body by a laser beam irradiated from the laser scanning unit. The developer transferred to the photosensitive body is transferred to the printing medium passing between the photosensitive body and the transfer medium. The printing medium then passes through the fixing unit. As a result, the visible image transferred to the printing medium is fused and fixed onto the printing medium by a fixing unit that applies high temperature and pressure.

Methods of developing an image using the developing unit are classified into a contact type developing method and a non-contact type developing method. In the contact type developing method, the developing roller rotates in contact with the photosensitive body. Alternatively, in the non-contact type developing method, the developing roller does not contact the photosensitive body to rotate and maintains a predetermined developing gap in relation to the photosensitive body.

In the contact type developing method, the developing performance of the developing roller is high. Additionally, a developing structure of the developing roller is simple, and parameters of outer sizes of the developing roller and the photosensitive body are flexible. However, high speed rotation of the developing roller is relatively difficult to achieve. High speed rotation is relatively difficult because the developing roller wears due to contact with the photosensitive body. The developing roller is also sensitive to environmental parameters. Therefore, high resolution may be compromised, and the surface of the developing roller may be pressed when the developing roller is not used for a long period.

In the non-contact type developing method, high resolution can be realized and high speed rotation of the developing roller is possible. However, toner on the surface of the developing roller is often scattered due to the high speed rotation.

Thus, the developing roller may become contaminated and may not able to maintain the predetermined developing gap.

Therefore, recently, the developing roller is configured to contact the photosensitive body during a developing process. However, the developing roller does not contact the photosensitive body after the developing process is finished or when the developing unit is not in operation. Consequently, a plurality of gear trains, operatively connected to a drive source for receiving power, are required to operate the developing roller. As a result, the developing roller has a relatively complicated structure.

Accordingly, there is a continual need for an improved image forming apparatus using a combination of contact and non-contact type developing methods to receive power from a drive source.

SUMMARY OF THE INVENTION

An aspect of the present invention is to solve at least the above problems and/or disadvantages and to provide at least the advantages described below. Accordingly, an aspect of the present invention is to provide an improved image forming apparatus using a combination of contact and non-contact type developing methods to exactly receive driving power to minimize vibration and noise.

In order to achieve the above-described aspects of the present invention, there is provided an image forming apparatus comprising a first developing unit comprising a photosensitive body. A second developing unit is provided comprising a developing roller. The developing roller is moveably installed to selectively contact the photosensitive body. A pressing member selectively presses the second developing unit so that the developing roller contacts the photosensitive body during a developing process but is separated from the photosensitive body after the developing process is finished.

The image forming apparatus may further comprise a power transmitting unit including an Oldham coupling for transmitting power from a drive source to the second developing unit.

The developing roller contacts the photosensitive body when the pressing member presses the second developing unit; however, the developing roller separates from the photosensitive body via the first elastic member when the pressing member is separated from the second developing unit.

The image forming apparatus further comprise a first elastic member to elastically bias the second developing unit so that the second developing unit separates from the first developing unit.

The image forming apparatus may further comprise a hinge shaft to hinge the second developing unit on the first developing unit so as to rotate the second developing unit, wherein the first elastic member is installed on the hinge shaft.

Another aspect of the present invention is to provide an image forming apparatus comprising a first developing unit having a photosensitive body. A second developing unit has a developing roller and is moveably installed so that the developing roller selectively contacts the photosensitive body. A pressing member selectively presses the second developing unit, wherein the developing roller is contacted with the photosensitive body during a developing process but separates from the photosensitive body after the developing process is finished. A second elastic member elastically biases the second developing unit toward the first developing unit.

The developing roller is separated from the photosensitive body when the pressing member presses the second developing unit but contacts with the photosensitive body via the second elastic member when the pressing member separates from the second developing unit.

The image forming apparatus may further comprise a hinge shaft to hinge the second developing unit on the first developing unit so as to rotate the second developing unit. The first developing unit may be disposed above the second developing unit.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
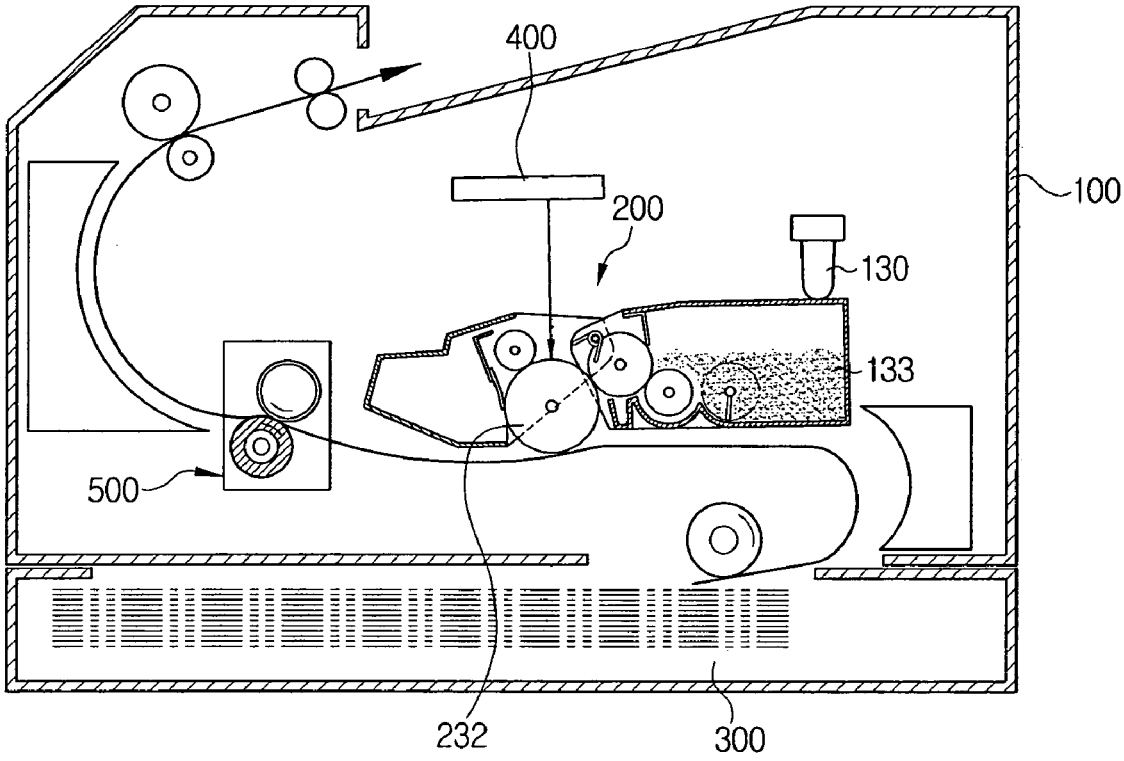
FIG. 1 is a schematic view of an image forming apparatus in accordance with an embodiment of the present invention.

FIG. 1 is a schematic view of an image forming apparatus in accordance with an embodiment of the present invention. Referring to FIG. 1, the image forming apparatus comprises a developing unit 200 installed inside a body 100. The body 100 includes first and second developing units 230 and 210, a pressing member 130, a hinge shaft 260, a first elastic member 270, a paper feeding unit 300, a laser scanning unit 400, and a fixing unit 500.

Figure 2:
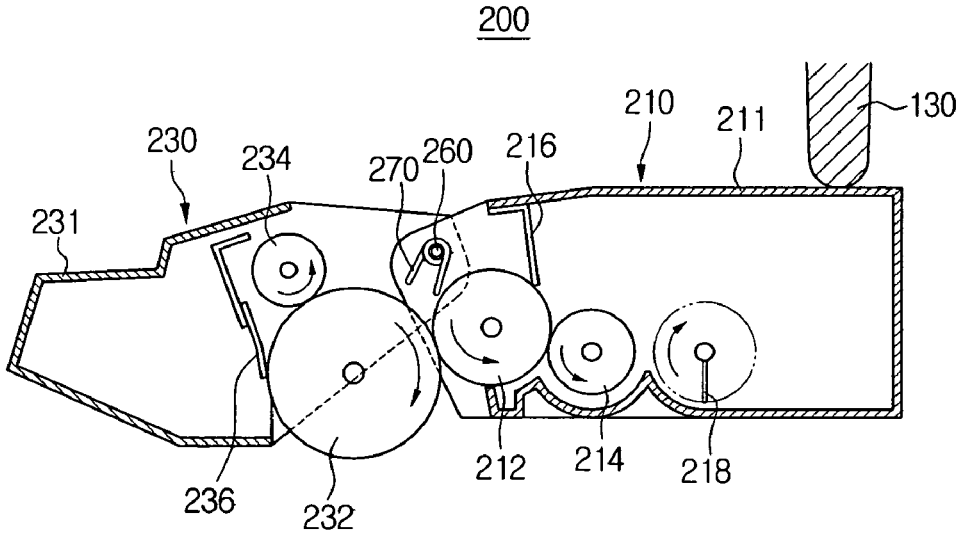
FIGS. 2 and 3 are sectional views of a developing unit as shown in FIG. 1

As shown in FIG. 2, the developing unit 200 comprises the first and second developing units 230 and 210. The first developing unit 230 comprises a first housing 231, a photosensitive body 232, a cleaning member 236, and a charging member 234. The second developing unit 210 comprises a second housing 211, a developing roller 212, a supplying roller 214, and a developer layer regulating member 216.

The first developing unit 230 is fixed to the body 100 of the image forming apparatus. The photosensitive body 232 is rotatably installed on the first housing 231. A portion of the photosensitive body 232 is exposed to the outside to facilitate transfer. The cleaning member 236 contacts the photosensitive body 232 to remove waste developer which remains on the photosensitive body 232. In the present embodiment, the cleaning member 236 is preferably a cleaning blade having elasticity. The charging member 234 charges the surface of the photosensitive body 232 with a predetermined potential. In the present embodiment, a conductive rubber roller rotates in contact with the photosensitive body 232 and is used for the charging member 234.

The second developing unit 210 stores a developer 133 and is installed on the body 100 so as to rotate on the hinge shaft 260. The developing roller 212 faces the photosensitive body 232 so as to selectively contact the photosensitive body 232, to preferably rotate inside the second housing 211, and to supply the photosensitive body 232 with the developer 133 to form an image. The developing roller 212 is preferably a conductive rubber roller or a cylindrical metallic roller made of an aluminum material; however, other suitable materials maybe used. Additionally, the surface of the cylindrical metallic roller may be sandblasted and plated with nickel (Ni). The supplying roller 214 supplies the developing roller 212 with the developer 133. The developer layer regulating member 216 regulates a developer layer on the surface of the developing roller 212 to a predetermined thickness. The supplying roller 214 rotates in a direction along which the developing roller 212 rotates. Furthermore, the supplying roller 214 supplies the developer 133 between the developing roller 212 and the developer layer regulating member 216. The developer layer regulating member 216 is formed by bending a relatively elastic stainless thin film having a substantially "L" shaped configuration. The developer layer regulating member 216 is fixed to the second housing 211 so as to contact the developing roller 212. An agitator 218 is rotatably installed on the second housing 211 to agitate the developer 133.

The pressing member 130 is installed on the second developing unit 210 to move up and down so as to selectively press the second housing 211 of the second developing unit 210. The pressing member 130 may be moved by various driving means such as a solenoid (not shown), and a motor (not shown).

The hinge shaft 260 couples the first and second developing units 230 and 210 and supports the first elastic member 270. The hinge shaft 260 is a rotatable shaft located on the second developing unit 210. The developing roller 212 separates from the photosensitive body 232 due to the rotation of the second developing unit 210 with respect to the first developing unit 230.

Figure 3:
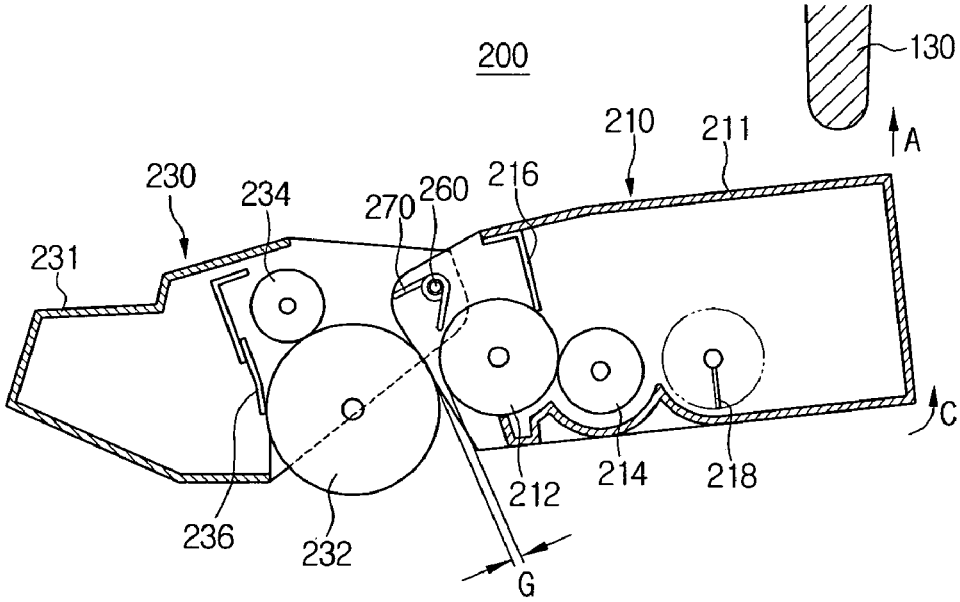

The first elastic member 270 is supported by the hinge shaft 260 to elastically bias the second developing unit 210 in a predetermined direction and at a predetermined distance from the first developing unit 230. Referring to FIG. 2, the second developing unit 210 is biased towards the first developing unit 230 by the pressing member 130 during the developing process, thereby contacting the photoconductive body 232 with the developing roller 212. However, after the developing process, the pressing member 130 moves in a direction denoted by reference character A to separate from the second developing unit 210 (FIG. 3). Therefore, the second developing unit 210 pivots in a direction denoted by reference character C via the first elastic member 270, thereby separating the photoconductive body 232 from the developing roller 212 by a predetermined distance G.

The paper feeding unit 300 feeds a printing medium to the developing unit 200. The laser scanning unit 400 irradiates a laser beam onto the photosensitive body 232 installed on the developing unit 200 to form an electrostatic latent image corresponding to a desired image. The fixing unit 500 applies high temperature and pressure to the printing medium which passes through the developing unit 200 to fix the image onto the printing medium. The paper feeding unit 300, the laser scanning unit 400, and the fixing unit 500 are generally well-known and a detailed description of these components are omitted for clarity and conciseness.

Figure 4:
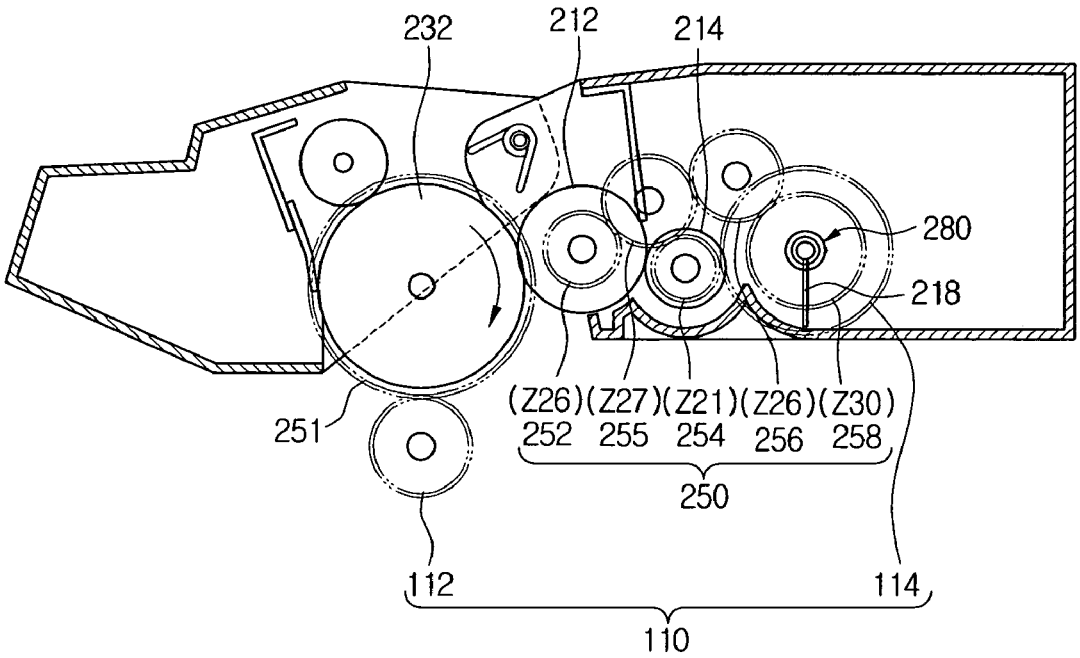
FIG. 4 is a sectional view of a power transmitting unit shown as shown in FIG. 2.

FIG. 4 is a view illustrating a power transmitting unit 250 and a driving unit 110 in accordance with an embodiment of the present invention. Referring to FIG. 4, the driving unit 110 comprises a drive source (not shown) installed on the body 100 of the image forming apparatus. A first driving gear 112 transmits power of the drive source to the power transmitting unit 250 and drives the photosensitive body 232 of the first developing unit 230. A second driving gear 114 drives components of the second developing unit 210. The first driving gear 112 transmits power to a photosensitive body gear 251 to rotate the photosensitive body 232. In the present embodiment, the first driving gear 112 is coaxial with a drive shaft (not shown) of the drive source.

Figure 5A:
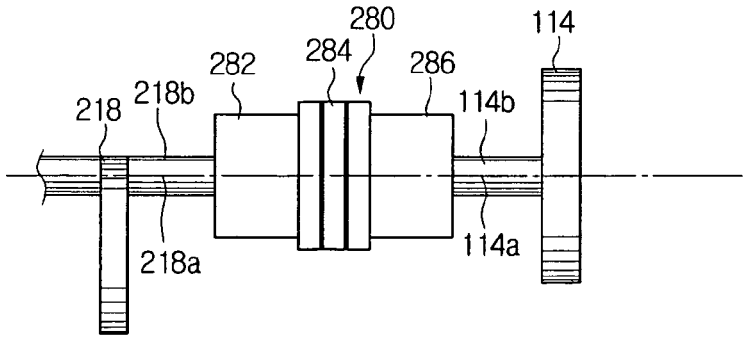
FIGS. 5A and 5B are views illustrating the operation of an Oldham coupling in accordance with an embodiment of the present invention.
Figure 5B:
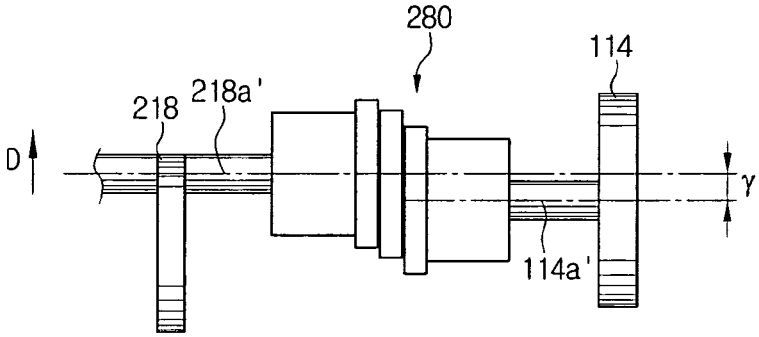

The power transmitting unit 250 comprises a developing roller gear 252, a supplying roller gear 254, first and second idle gears 255 and 256, an agitator gear 258, and an Oldham coupling 280 (refer to FIGS. 5A and 5B). The developing roller gear 252 is coupled to the developing roller 212, the supplying roller gear 254 is coupled to the supplying roller 214, the agitator gear 258 is coupled to the agitator 218, and the Oldham coupling 280 is coupled to the agitator gear 258 and the second driving gear 14. Power transmitted to the agitator gear 258 is transmitted to the second idle gear 256, the second idle gear 256 transmits the power to the first idle gear 255, and the first idle gear 255 transmits the power to the supplying roller gear 254 and the developing roller gear 252.

When a developing process is finished, the second developing unit 210 rotates at a predetermined angle. Thus the power transmitting unit 250 also rotates. A rotation axis of the power transmitting unit 250 changes due to the rotation of the second developing unit 210. Thus, when the rotation axis of the power transmitting unit 250 moves, the power transmitting unit 250 does not exactly receive driving power from the second driving gear 114. As a result, in the present invention, in order to solve this problem, the Oldham coupling 280 is used.

The Oldham coupling 280 is a coupling member for transmitting power relatively smoothly even though eccentricity occurs between two coupled axes. FIG. 5A illustrates the Oldham coupling 280 when the developing roller 212 contacts the photosensitive body 232 as shown in FIG. 2. FIG. 5B illustrates the Oldham coupling 280 when the developing roller 212 is separated from the photosensitive body 232 as shown in FIG. 3. The Oldham coupling 280 couples a rotation shaft 218*b* of the agitator 218 and a rotation shaft 114*b* of the second driving gear 114 to transmit rotation power of the second driving gear 114 to the agitator 218. Also, the Oldham coupling 280 comprises hubs 282 and 286 to couple the rotation shaft 218*b* of the agitator 218 and the rotation shaft 114*b* of the second driving gear 114. A coupling disc 284 couples the hubs 282 and 286. Referring to FIG. 5A, an axis 114*a* of the second driving gear 114 coincides with an axis 218*a* of the agitator 218. Referring to FIG. 5B, an axis 218*a*' of the agitator 218 does not coincide with an axis 114*a*' of the second driving gear 114. Thus, a predetermined amount of eccentricity γ occurs. However, although the eccentricity γ occurs, the Oldham coupling 280 can contribute to transmitting the rotation power of the second driving gear 114, which is rotatably fixed to the body 100, to the agitator 218 at a constant angular velocity. Thus, although the second developing unit 210 moves, the driving power of the second driving gear 114 can be transmitted to the agitator 218 due to the Oldham coupling 280.

In the present embodiment, the Oldham coupling 280 may be directly coupled to a rotation shaft (not shown) of the developing roller 212. Also, the Oldham coupling 280 may rotate a specific gear having a predetermined deceleration relative thereto in a specific position. In particular, since a relatively heavy load is put on the developing roller 212, the Oldham coupling 280 may be directly coupled to a driving component in the vicinity of the developing roller 212 to which a deceleration rate has been applied. For example, the supplying roller gear 254, the agitator gear 258, or the idle gears 255 and 256 are located in the vicinity of the Oldham coupling 280.

Figure 6:
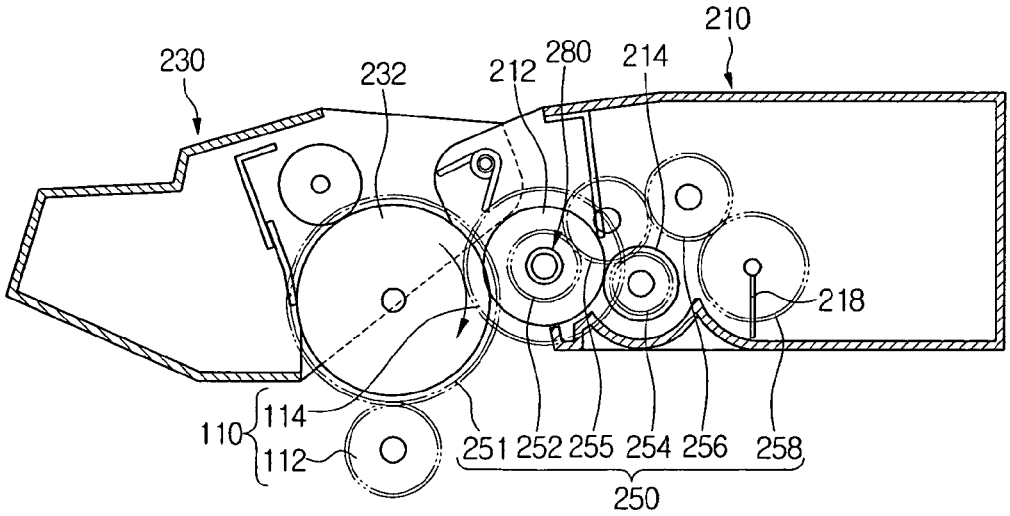
FIG. 6 is a view illustrating the Oldham coupling of FIG. 5 coupled to a rotation shaft of a developing roller.

FIG. 6 illustrates the Oldham coupling 280 coupled to the developing roller gear 252. In this case, the driving power of the second developing unit 210 is transmitted from the second driving gear 114 to the developing roller 212 via the Oldham coupling 280. Also, when the developing roller 212 rotates, the driving power of the developing roller 212 is transmitted to the supplying roller 214 via the first idle gear 255. The supplying roller gear 254 is sequentially coupled to the developing roller gear 252. As a result, the supplying roller 214 rotates. Next, the driving power is transmitted to the agitator 218 via the second idle gear 256. The agitator gear 258 is sequentially coupled to the first idle gear 255 so as to rotate the agitator 218.

When a friction load of the developing roller 212 is Td (1 kg·cm), a friction load of the supplying roller 214 is Ts (1 kg·cm), and the Oldham coupling 280 is coupled to the rotation shaft of the developing roller 212 (FIG. 6). A load which is applied to the Oldham coupling 280 is Tc, as expressed in [Equation 1] as follows:

$$Tc=Td+Ts*(Z27/Z21)*(Z26/Z27)=2.24\ \text{kgf·cm} \qquad \text{[Equation 1]}$$

In a case where the Oldham coupling 258 is coupled to the agitator gear 258 as shown in FIG. 4, a load applied to the Oldham coupling 280 is Tc, as expressed in [Equation] as follows:

$$Tc=[Td*(Z27/Z26)+Ts*(Z27/Z21)]*(Z26/Z27)*(Z30/Z26)=1.48\ \text{kgf·cm} \qquad \text{[Equation 2]}$$

As described above, the load on the Oldham coupling 280 may be reduced further when the Oldham coupling 280 drives a gear having a predetermined deceleration relative thereto as shown in FIG. 4 than when the assembly is directly driving the developing roller 212. Accordingly, vibration and noise occurring during the transmission of driving power from the drive source of the body 100 via a driving gear may be relatively minimized using an Oldham coupling.

The operation of the image forming apparatus shown in FIG. 1 will now be described with reference to FIGS. 2-5.

The agitator 218 rotates by receiving driving power from the drive source via the Oldham coupling 280 from the power transmitting unit 250, the second idle gear 256, the first idle gear 255, the supplying roller gear 254, and the developing roller gear 252. As a result, the developing roller 212 and the supplying roller 214 also rotate. Thus the developer 133 is supplied to the developing roller 212 (refer to FIG. 4).

When developing starts, the pressing member 130 presses the upper surface of the second housing 211 of the second developing unit 210 as shown in FIG. 2. Consequently, the first elastic member 270 installed on the hinge shaft 260 is compressed. As a result, the second developing unit 210 moves toward the first developing unit 230, and the developing roller 212 contacts the photosensitive body 232 to supply the photosensitive body 232 with the developer 133. Thus, an image is formed. Here, the Oldham coupling 280 is in the state shown in FIG. 5A.

When the image is completely formed on the photosensitive body 232 or when developing is not being performed, the pressing member 130 moves upward to separate from the second developing unit 210 as shown in FIG. 3. Here, the first elastic member 270 pushes the second developing unit 210 toward the opposite direction (direction denoted by reference character C shown in FIG. 3) to the direction in which the first developing unit 230 is positioned. Then, the developing roller 212 separates from the photosensitive body 232. Here, the Oldham coupling 280 does not coincide with the rotation shaft 218*b* of the agitator 218 and thus has eccentricity as shown in FIG. 5B.

Figure 7:
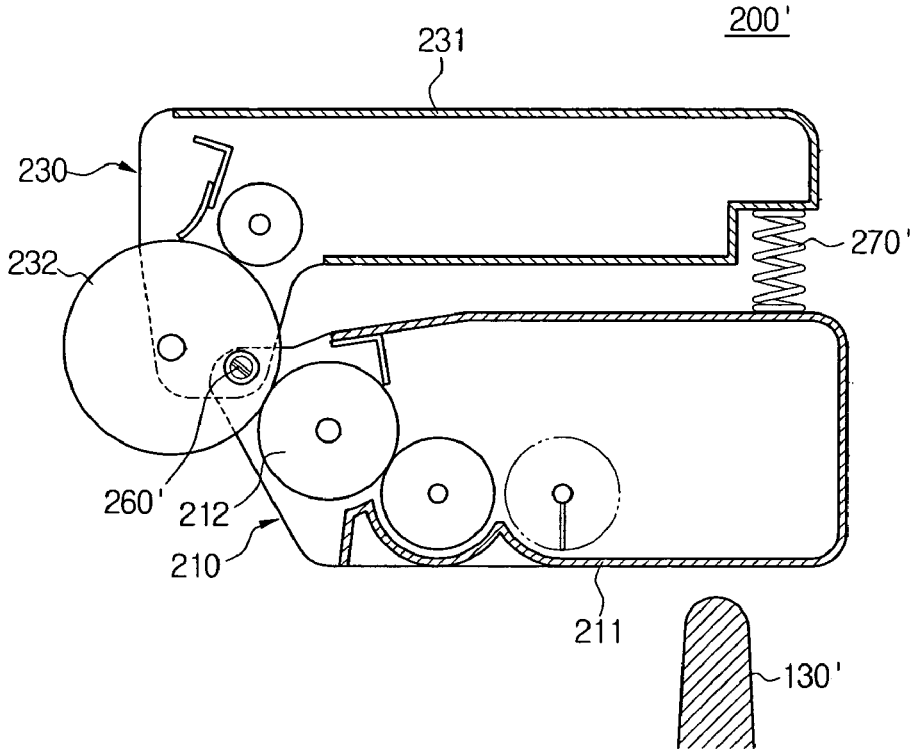
FIGS. 7 and 8 are views of a developing unit in accordance with another embodiment of the present invention.
Figure 8:
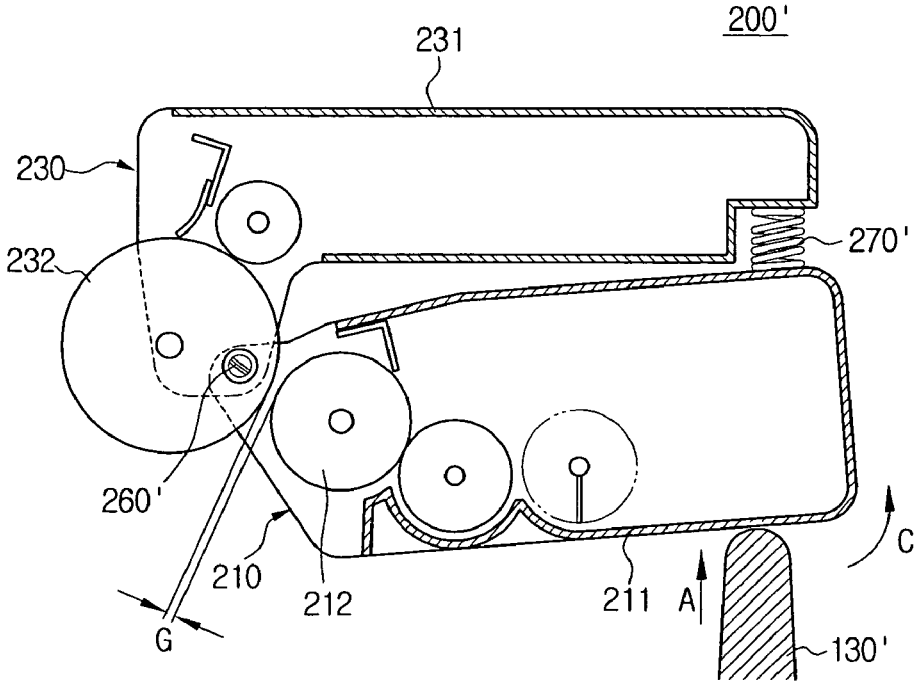

FIGS. 7 and 8 are sectional views illustrating a developing unit 200' of the image forming apparatus in accordance with another embodiment of the present invention. In the present embodiment, a first developing unit 230 is disposed above a second developing unit 211. A second elastic member 270' is installed between the first and second developing units 230 and 210 so as to contact the first and second developing units 230 and 210. As shown in FIG. 7, during a developing process, a pressing member 130' does not interfere with the second housing 211. The first and second housings 231 and 211 are spaced apart from each other due to an elastic force of the second elastic member 270'. Thus, the developing roller 212 contacts the photosensitive body 232. As shown in FIG. 8, when the developing process is finished, the pressing member 130' advances in direction denoted by reference character A to press the second housing 211. Thus, the second elastic member 270' is compressed so that the second housing 211 rotates in direction denoted by reference character C. As a result, the developing roller 212 keeps a predetermined developing gap G from the photosensitive body 232.

Figure 9:
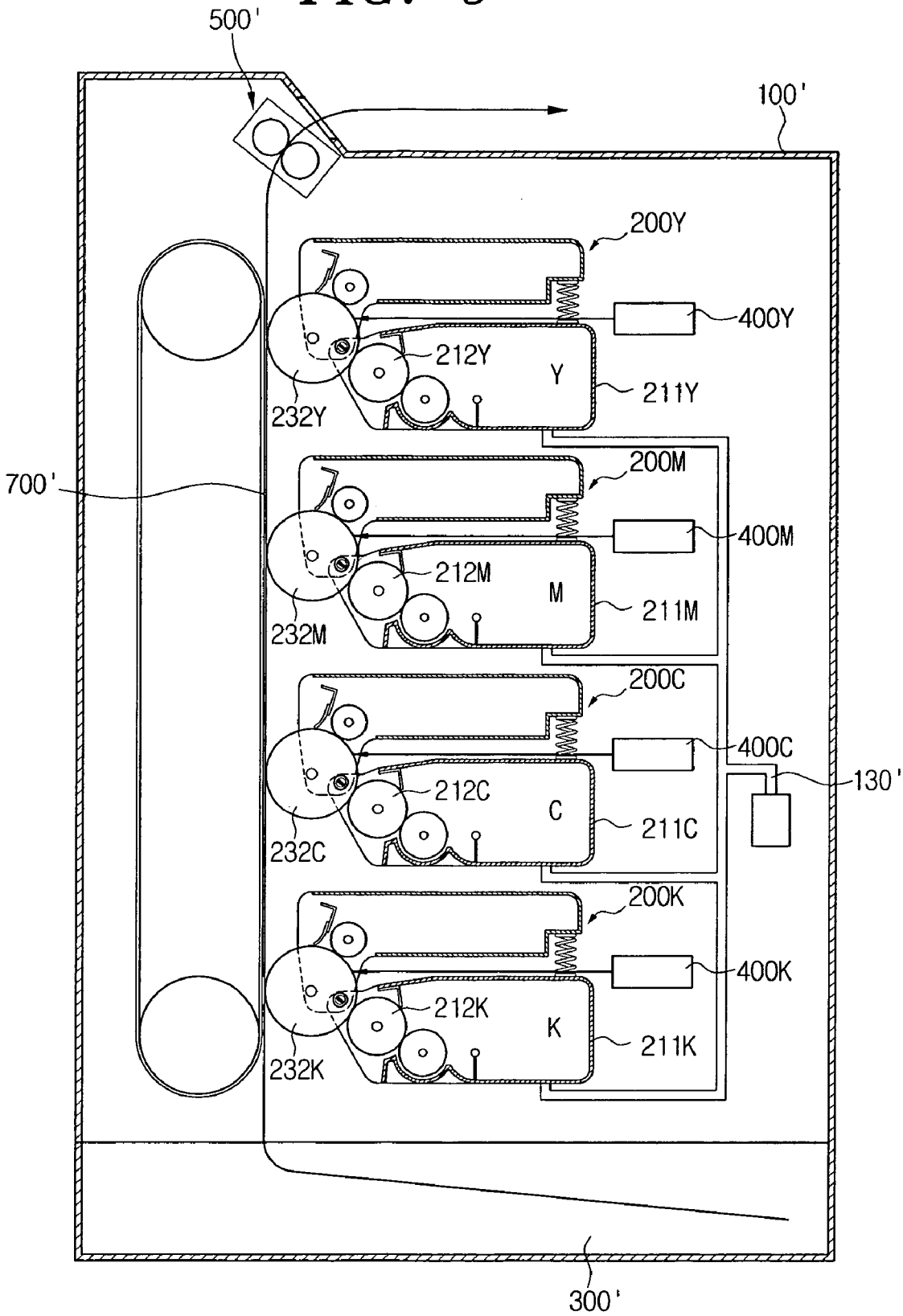
FIGS. 9 and 10 are schematic views of an image forming apparatus adopting a plurality of developing units shown in FIGS. 7 and 8.
Figure 10:
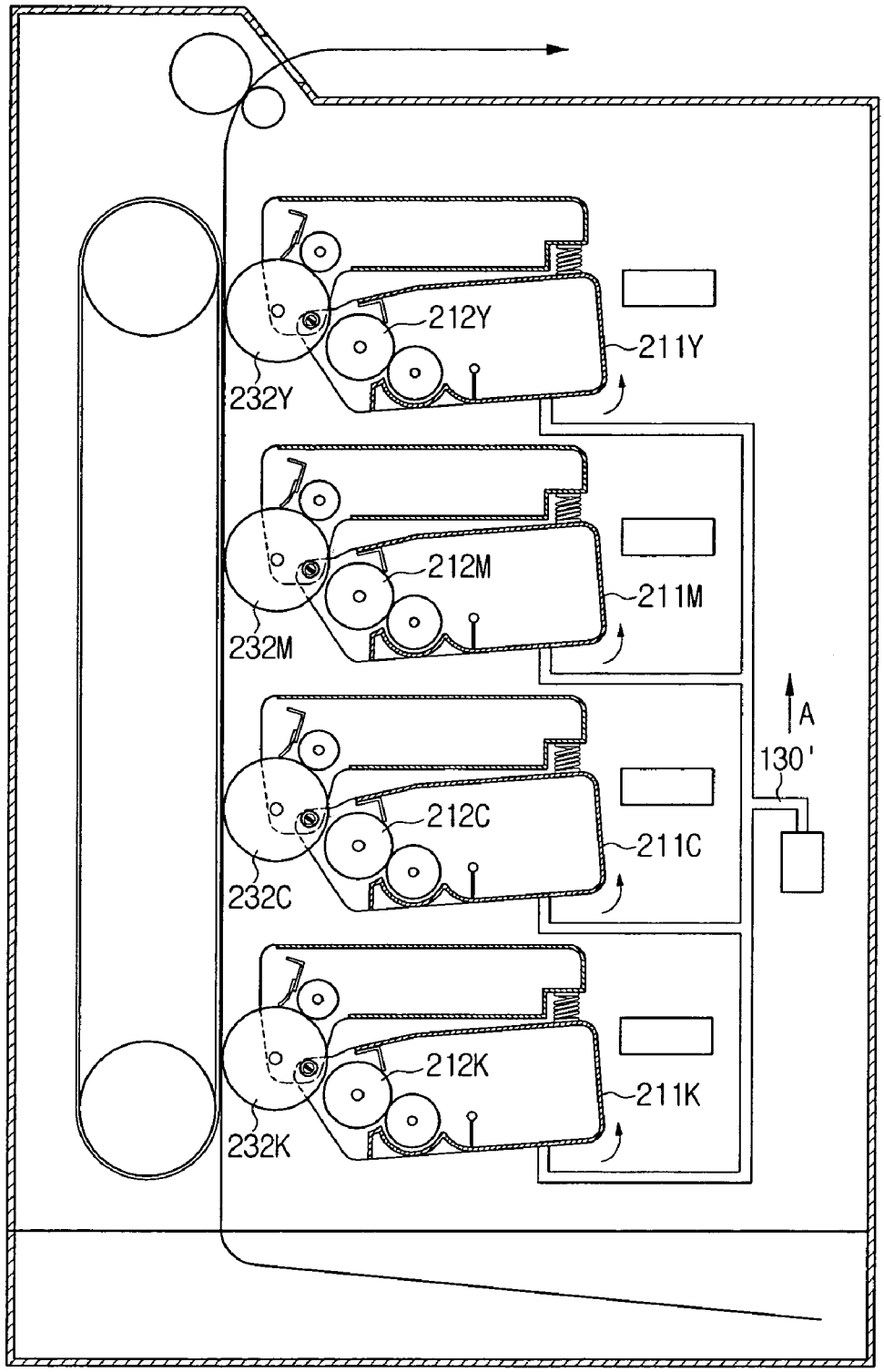

FIGS. 9 and 10 are views of an image forming apparatus in accordance with another embodiment of the present invention. The image forming apparatus of the previous embodiment is a black and white (mono) image forming apparatus using one developing unit 200. The image forming apparatus of the present embodiment is a color image forming apparatus using a plurality of developing units. The image forming apparatus of the present embodiment comprises a plurality of developing units 200Y, 200M, 200C, and 200K which are installed on a body 100' and respectively develop yellow (Y), magenta (M), cyan (C), and black (K) colors. Also provided are a paper feeding unit 300', laser scanning units 400Y, 400M, 400C, and 400K which respectively irradiate a laser beam to the photosensitive bodies 232Y, 232M, 232C, and 232K, a fixing unit 500', and a transfer medium 700' which is installed in contact with the photosensitive bodies 232Y, 232M, 232C, and 232K to transfer images formed on the photosensitive bodies 232Y, 232M, 232C, and 232K to a printing medium passing between the transfer medium 700' and the photosensitive bodies 232Y, 232M, 232C, and 232K.

As shown in FIGS. 9 and 10, a pressing member 130' is coupled to second housings 211Y, 211M, 211C, and 211K of the developing units 200Y, 200M, 200C, and 200K. When the developing units 200Y, 200M, 200C, and 200K perform a developing process, second developing roller 212Y, 212M, 212C, 212K contact the photosensitive bodies 232Y, 232M, 232C, 232K, respectively, as shown in FIG. 9 so as to perform the developing process. When the developing process is finished, as shown in FIG. 10, the pressing member 130' moves in direction denoted by reference character A. Thus, the second housings 211Y, 211M, 211C, and 211K of the developing units 200Y, 200M, 200C, and 200K rotate in direction indicated by arrows. As a result, the developing roller 212Y, 212M, 212C, and 212K are respectively spaced apart from the photosensitive bodies 232Y, 232M, 232C, and 232K.

As described above, a developing unit comprises first and second developing units. Also, the second developing unit rotates using a pressing member and an elastic member. Thus, the image forming apparatus can have a simple structure. As a result, high resolution can be realized, and the volume of the image forming apparatus can be reduced.

Moreover, a rotation force can be transmitted to each component of the second developing unit using an Oldham coupling.

While the invention has been shown and described with reference to certain embodiments thereof, it will be understood by those skilled in the art that various changes in form and details may be made therein without departing from the spirit and scope of the invention as defined by the appended claims.

What is claimed is:

1. An image forming apparatus comprising:

a first developing unit having a photosensitive body;

a second developing unit having a developing roller being moveably installed so that the developing roller selectively contacts the photosensitive body;

a pressing member to selectively press the second developing unit so that the developing roller contacts with the photosensitive body during a developing process but separates from the photosensitive body after the developing process is finished; and a hinge to hinge the second developing unit on the first developing unit so as to rotate the second developing unit, wherein a first elastic member is installed on the hinge.

2. The image forming apparatus of claim 1, further comprising a power transmitting unit comprising an Oldham coupling to transmit power from a drive source to the second developing unit.

3. The image forming apparatus of claim 2, wherein the power transmitting unit comprises a developing roller gear and a plurality of gears, and the Oldham coupling is coupled to one of the plurality of gears to apply a lighter load than the developing roller gear.

4. The image forming apparatus of claim 2, wherein the pressing member moves up and down to selectively press the second developing unit.

5. The image forming apparatus of claim 3, further comprising a first elastic member elastically biasing the second developing unit so that the second developing unit separates from the first developing unit.

6. The image forming apparatus of claim 5, wherein the first elastic member comprises a spring.

7. The image forming apparatus of claim 6, wherein the developing roller contacts with the photosensitive body when the pressing member presses the second developing unit but is separated from the photosensitive body via the first elastic member when the pressing member separates from the second developing unit.

8. The image forming apparatus of claim 1, wherein the pressing member moves up and down to selectively press the second developing unit.

9. An image forming apparatus comprising:

a first developing unit having a photosensitive body;

a second developing unit having a developing roller being moveably installed so that the developing roller selectively contacts the photosensitive body; and a pressing member to selectively press the second developing unit so that the developing roller contacts with the photosensitive body during a developing process but separates from the photosensitive body after the developing process is finished;

a first elastic member to elastically bias the second developing unit so that the second developing unit separates from the first developing unit; and a hinge to hinge the second developing unit on the first developing unit so as to rotate the second developing unit, wherein the first elastic member is installed adjacent to the hinge.

10. The image forming apparatus of claim 9, further comprising a power transmitting unit comprising an Oldham coupling to transmit power from a drive source to the second developing unit.

11. The image forming apparatus of claim 10, wherein the power transmitting unit comprises a developing roller gear and a plurality of gears, and the Oldham coupling is coupled to one of the plurality of gears to apply a lighter load than the developing roller gear.

12. The image forming apparatus of claim 10, wherein the pressing member moves up and down to selectively press the second developing unit.

13. The image forming apparatus of claim 9, wherein the first elastic member comprises a spring.

14. The image forming apparatus of claim 13, wherein the developing roller contacts with the photosensitive body when the pressing member presses the second developing unit but is separated from the photosensitive body via the first elastic member when the pressing member separates from the second developing unit.

15. The image forming apparatus of claim 9, wherein the pressing member moves up and down to selectively press the second developing unit.

* * * * *